US012760607B2

(12) United States Patent
Olander et al.

(10) Patent No.: US 12,760,607 B2
(45) Date of Patent: Oct. 13, 2026

(54) SEMI-AUTOMATIC DIRECTIONAL DRILL AND METHOD

(71) Applicant: TT Technologies, Inc., Aurora, IL (US)

(72) Inventors: John A. Olander, Clayton, WI (US); Noah Raymond Ericson, Plainfield, IL (US)

(73) Assignee: TT Technologies, Inc., Aurora, IL (US)

( * ) Notice: Subject to any disclaimer, the term of this patent is extended or adjusted under 35 U.S.C. 154(b) by 135 days.

(21) Appl. No.: 18/775,275

(22) Filed: Jul. 17, 2024

(65) Prior Publication Data

US 2025/0027374 A1 Jan. 23, 2025

Related U.S. Application Data

(60) Provisional application No. 63/527,256, filed on Jul. 17, 2023.

(51) Int. Cl.
*E21B 19/16* (2006.01)
*E21B 7/04* (2006.01)

(52) U.S. Cl.
CPC ..... *E21B 19/166* (2013.01); *E21B 7/046* (2013.01)

(58) Field of Classification Search
CPC ..... E21B 19/16–20; E21B 7/046
See application file for complete search history.

(56) References Cited

U.S. PATENT DOCUMENTS

2008/0185185 A1* 8/2008 Mitchell ..... E21B 7/046 175/27
2014/0299313 A1* 10/2014 Messmer ..... F16B 2/10 166/77.51
2020/0217151 A1* 7/2020 Ramos ..... E21B 7/046
2020/0278193 A1* 9/2020 Orban ..... E21B 17/006

* cited by examiner

*Primary Examiner* — Kristyn A Hall
(74) *Attorney, Agent, or Firm* — Schwegman Lundberg & Woessner, P.A.

(57) ABSTRACT

A horizontal directional drill and associated methods are disclosed. Examples are shown that include providing a linear bump to threads of a drill string to aid in thread engagement. Examples are also shown that include monitoring a linear location of a drill head to detect a threading or unthreading linear speed.

20 Claims, 8 Drawing Sheets

DEPRESSES CYCLE BUTTON (DRILL HEAD IS FORWARD)

AUTOMATICALLY

1. ENGINE SPEED CHANGES TO A PREPROGRAMED SPEED
2. FRONT VICE CLOSES (DRILL FLUID MAY ALSO BE TURNED OFF)
3. MONITOR FRONT VICE PRESSURE

302

VICE PRESSURE IS REACHED THEN AUTOMATICALLY

1. BEGIN DRILL HEAD COUNTER ROTATION (a set speed)
2. SMALL REARWARD THRUST IS APPLIED
3. MONITOR DRILL HEAD MOVEMENT (ACTUAL SPEED)

304

(LEARNING)

CALCULATE THRUST COMMAND BASED ON ACTUAL SPEED THEN

AUTOMATICALLY

1. ADJUST THRUST COMMAND TO MATCH ACTUAL SPEED
2. DRILL HEAD DISENGAUGES THREAD
3. DRILL HEAD MOVES REAR THRU THE GREASING POSITION &
4. GREASE COMMAND IS EXECUTED AT THE PROPER POSITION
5. DRILL HEAD ACCELERATES TO REACH THE ROD LOADING POSITION
(OPERATOR NEEDS TO SIMULTANEOUSLY DEPRESS A CYCLE BUTTON ON EACH JOYSTICK)
6. DRILL HEAD DECELERATES AND STOPS IN THE PROPER POSTION.

306

THE OPERATOR INSTALLS A DRILL ROD

THE OPERATOR DEPRESSES THE CYCLE BUTTON

AUTOMATICALLY

1. ENGINE SPEED CHANGES TO A PREPROGRAMED SPEED
2. BEGIN DRILL HEAD CLOCKWISE ROTATION (a set speed)
3. MOVE DRILL HEAD FORWARD JUST SHORT OF THREAD ENGAUGEMENT
4. APPLY A SHORT DURATION FORWARD THRUST COMMAND (BUMP)
5. APPLY COMAND SO DRILL HEAD THRUST IS IN A FLOAT CONDTION
6. MONITOR DRILL HEAD MOVEMENT

308

(LEARNING)

CALCULATE THRUST COMMAND BASED ON MOVEMENT THEN

AUTOMATICALLY

1. IF NO MOVEMENT IS PRESSENT = REPEAT STEP 4 ABOVE (BUMP)
2. IF MOVEMENT IS PRESSENT = LEAVE AS IN STEP 5 ABOVE (FLOAT)
3. THREAD THE DRILL STEM TOGETHER
4. COMPLETE THE THREAD TORQUE SEQUENCE

310

THE OPERATOR DEPRESSES THE CYCLE BUTTON

AUTOMATICALLY

1. ENGINE SPEED CHANGES TO THE OPERATOR SELECTED SPEED
2. FRONT VICE OPENS (DRILL FLUID MAY ALSO BE TURNED ON)

312

The operator can drill out the next stem and repeat the sequence.

FIG. 3

300

DEPRESSES CYCLE BUTTON (DRILL HEAD IS REAR WITH THE DRILL STEM JOINT PROPERLY LOCATED IN THE VICE)

AUTOMATICALLY

1. ENGINE SPEED CHANGES TO A PREPROGRAMED SPEED
2. FRONT & REAR VICE CLOSE (DRILL FLUID MAY BE TURNED OFF)
3. WRENCH IS ACTIVATED TO THE UNTHREAD POSITION
4. REAR VICE OPENS
5. WRENCH IS RETURNED TO THE HOME POSITION
6. BEGIN DRILL HEAD COUNTER ROTATION (set speed)
7. ADJUST THRUST COMMAND TO THAT LEARNED WHEN DRILLING OUT
8. DRILL STEM DISENGAUGES THREAD
9. DRILL HEAD WITH STEM MOVES REAR TO POSITION IN REAR VICE
10. REAR VICE CLOSES
11. BEGIN DRILL HEAD COUNTER ROTATION (a set speed)
12. ADJUST THRUST COMMAND TO THAT LEARNED WHEN DRILLING OUT
13. DRILL HEAD DISENGAUGES THREAD
14. DRILL HEAD MOVES REAR TO CLEAR THE DRILL ROD FOR REMOVAL

402

THE OPERATOR REMOVES THE DRILL ROD

THE OPERATOR DEPRESSES THE CYCLE BUTTON (OPERATOR NEEDS TO SIMULTANEOUSLY DEPRESS A CYCLE BUTTON ON EACH JOYSTICK)

AUTOMATICALLY

1. DRILL HEAD ACCELERATES FORWARD
2. DRILL HEAD DECELERATES AND SLOWS THRU THE GREASING POSITION &
3. GREASE COMMAND IS EXECUTED AT THE PROPER POSITION
4. DRILL HEAD MOVES FORWARD JUST SHORT OF THREAD ENGAUGEMENT
5.APPLY A SHORT DURATION FORWARD THRUST COMMAND (BUMP)
6. APPLY COMAND SO DRILL HEAD THRUST IS IN A FLOAT CONDTION
7.MONITOR DRILL HEAD MOVEMENT

404

(LEARNING)

CALCULATE THRUST COMMAND BASED ON MOVEMENT THEN

AUTOMATICALLY

1. IF NO MOVEMENT IS PRESSENT = REPEAT STEP 4 ABOVE (BUMP)
2. IF MOVEMENT IS PRESSENT = LEAVE AS IN STEP 5 ABOVE (FLOAT)
3. THREAD THE DRILL STEM TOGETHER
4. COMPLETE THE THREAD TORQUE SEQUENCE

406

THE OPERATOR DEPRESSES THE CYCLE BUTTON

AUTOMATICALLY

1. ENGINE SPEED CHANGES TO THE OPERARTOR SELECTED SPEED
2. FRONT VICE OPENS (DRILL FLUID MAY ALSO BE TURNED ON)

408

The operator can pull back the next stem and repeat the sequence.

FIG. 4

400

SEMI-AUTOMATIC DIRECTIONAL DRILL AND METHOD

CLAIM OF PRIORITY

This patent application claims the benefit of priority, under 35 U.S.C. § 119 (e), to U.S. Provisional Patent Application Ser. No. 63/527,256, entitled "SEMI-AUTOMATIC DIRECTIONAL DRILL AND METHOD," filed on Jul. 17, 2023, which is hereby incorporated by reference herein in its entirety.

TECHNICAL FIELD

Embodiments described herein generally relate to directional drills and associated methods.

BACKGROUND

Directional drilling involves the assembly and disassembly of a plurality of drill stem segments. In many directional drilling projects, a smaller, more maneuverable directional drill is desired. One example type of project includes, but is not limited to, replacement of residential natural gas lines into individual houses. Smaller directional drill strings are sometimes manually loaded and unloaded. For safety and efficiency, it is desirable to automate operations of a drilling operation. Integrating automation into a smaller, directional drill can be challenging. Improved devices and methods are desired for directional drills and components that addresses these and other concerns.

BRIEF DESCRIPTION OF THE DRAWINGS

FIG. 3 shows a list of operations for a drill out sequence in accordance with some example embodiments.

FIG. 4 shows a list of operations for a pull-back sequence in accordance with some example embodiments.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
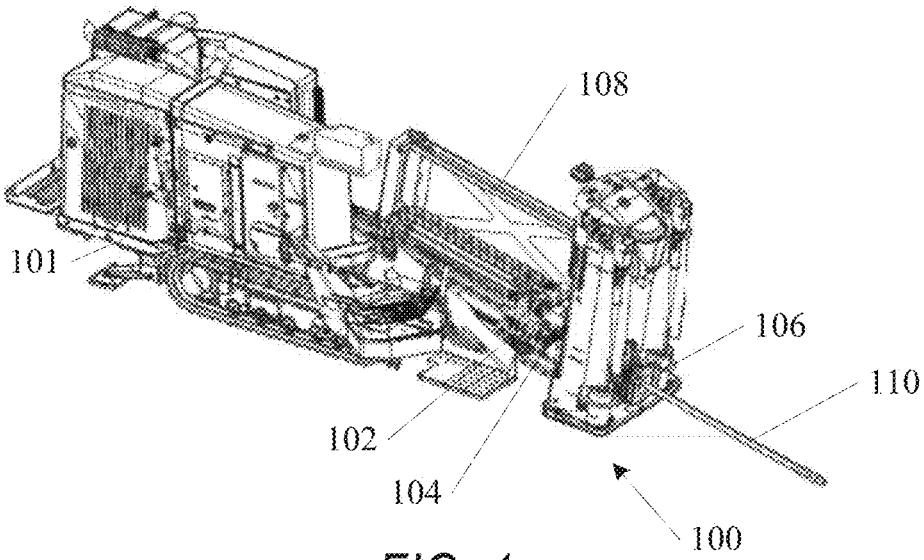
FIG. 1 shows a directional drill in accordance with some example embodiments.

FIG. 1 shows an example of a directional drill 100. The directional drill 100 includes a drill head 102 mounted on a moving carriage 104. The moving carriage 104 is adapted to move back and forth on a drill frame 101. A drill stem vise 106 is shown located at a front end of the drill frame 101. A drill sting 110 composed of one or several drill stem segments is shown coupled to the drill head 102, and passing through the drill stem vise 106.

A drill stem magazine 108 is shown coupled to the drill frame 101 in the example of FIG. 1, although the invention is not so limited. In examples using a drill stem magazine 108, drill stem segments are at least partially automatically loaded and unloaded between the drill stem magazine 108 and the drill string 110. In other configurations, a drill stem magazine is not included, and drill stem segments are hand loaded from a collection of drill stem segments that may be located apart from the directional drill 100.

Figure 2:
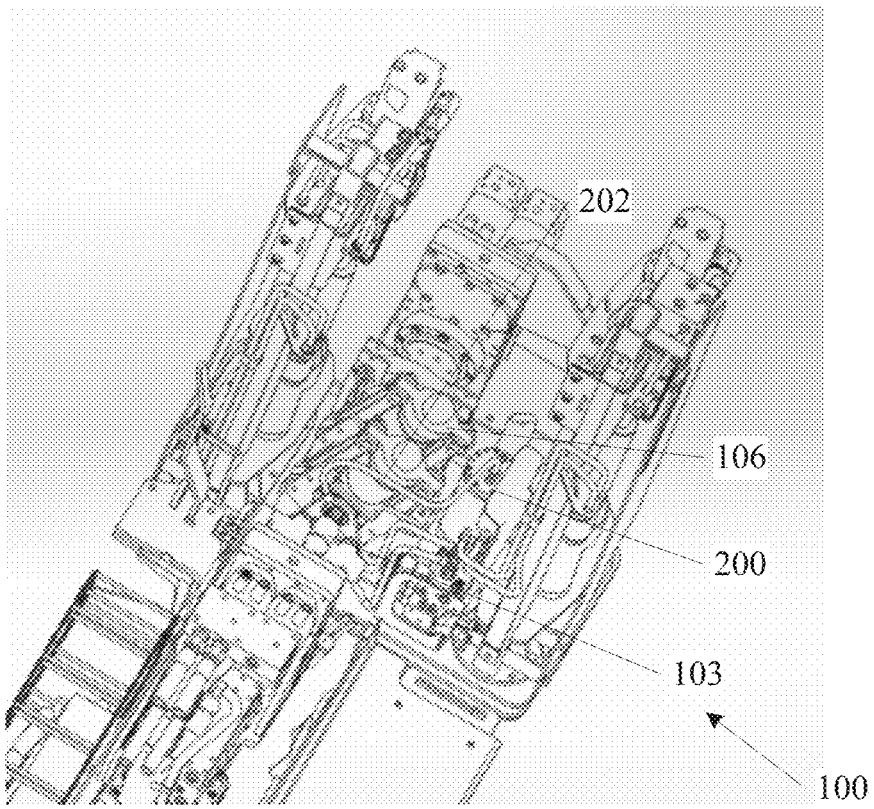
FIG. 2 shows selected portions of a directional drill in accordance with some example embodiments.

FIG. 2 shows selected portions of the directional drill 100 from FIG. 1. FIG. 2 further shows a drill stem grease system 200 coupled adjacent to the drill stem vice 106. A tube 202 is shown extending from the drill stem grease system 200 to a location adjacent to one set of jaws of the drill stem vice 106. In operation, drill stem segments will pass through jaws of the drill stem vice 106. A location adjacent to jaws of the drill stem vice is therefore a good place to grease connection threads of drill stem segments.

In one example, a sub saver 103 is defined as a drill stem thread that is greased. In operation, the sub saver 103 is coupled to the drill head 102 as shown in FIG. 1. The sub saver 103 is used over and over to insert and/or remove each drill stem segment. In operation, when grease is applied to threads on the sub saver 103, some of the grease on the sub saver 103 is then transferred to each drill string segment being driven by the sub saver 103 and the drill head 102. In this way, all drill stem segments in a drill string will receive some of the grease applied to the sub saver as each successive drill string segment is driven into the ground. Although applying grease to the sub saver 103 is used as an example, the invention is not so limited. In other examples, grease is applied to the threads of each drill string segment directly as they are added to the drill string.

FIG. 3 shows a sequential list 300 of operations that automate selected operations of extending a drill string out from a directional drill to a desired location for installing or replacing an underground service. FIGS. 5A-5D illustrate selected stages of operations of a directional drill 500 in block diagram form and are referenced in discussion of operations as shown in FIGS. 3 and 4.

Figure 5A:
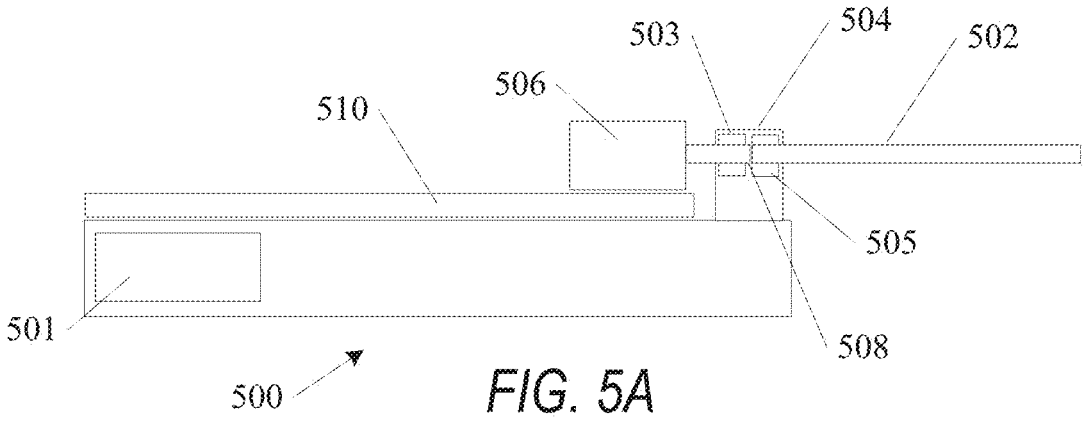
FIG. 5A-5D show selected stages of operations from FIG. 3 in block diagram format in accordance with some example embodiments.
Figure 5B:
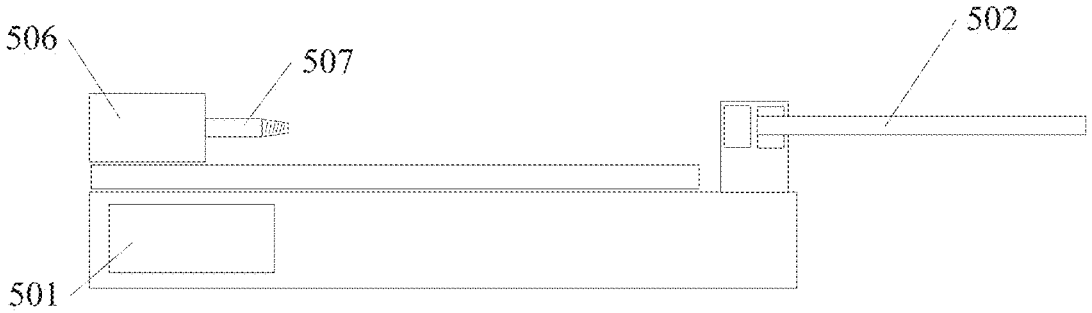

In operation series 302, a baseline status of a directional drill is established. As illustrated in FIG. 5A, at the beginning stage of operation series 302, a drill stem segment 502 is located in the directional drill 500, within a drill stem vise 504. The drill head 506 is threaded into the drill stem segment 502 and forms a joint interface 508. In FIG. 5A, the drill head 506 is in a distal location on a carriage 510.

In operation series 302, a preprogrammed engine speed is implemented, and a front vise 505, of the drill stem vise 504 is closed. A hydraulic pressure in the front vise 505 of the drill stem vise 504 may be monitored to indicate to drill circuitry 501 that the front vise 505 of the drill stem vise 504 is closed and clamped on a drill stem segment 502. Circuitry 501 is shown in block diagram format in FIGS. 5A-5C for illustration purposes. No actual location of the circuitry 501 is indicated in the Figures. Implementation of the preprogrammed engine speed provides a known amount of power that is available to run any of a number of directional drill components, including, but not limited to, linear thrust of the drill head 506 along the carriage 510, rotation of the drill head 506, clamping pressure of a front 505 or rear 503 vise in the drill stem vise 504, etc.

In operation series 304, the drill head 506 is counter rotated at a set rotation speed. In one example, a small rearward thrust is applied along the carriage 510 from FIGS. 5A-5C. Because the drill stem segment 502 is clamped in the front vise 505 of the drill stem vise 504, it remains fixed. The sub saver 507 of the drill head 506 begins to unthread from the drill stem segment 502. As indicated in operation series 304, a rate of rearward movement of the drill head 506 is monitored as the sub saver 507 is unthreaded from the drill stem segment 502. By monitoring the rate of rearward movement of the drill head 506, an effective pitch of the threads and rate of threading/unthreading is learned and is stored in the circuitry 501. In one example, future threading operations utilize the stored rate of threading/unthreading as described in more detail below.

In operation series 306, the stored rate of threading/unthreading is used to set a rearward thrust speed of the drill head 506 along the carriage 510. Once the sub saver 507 is disengaged from the drills stem segment 502, the drill head 506 is moved towards a rear of the carriage 510. In one example, the drill head 506 first stops with threads of the sub saver 507 located at a greasing station between the vise 504 and the rear of the carriage 510. Grease is applied to the threads of the sub saver 507, and the drill head 506 then continues to a rear of the carriage 510 to a rod loading location. The directional drill condition is now illustrated in FIG. 5B.

In one example, operation series 302, 304, and 306 are all performed automatically using programmed circuitry 501. In one example, after operation series 306, a second drill stem segment 320 is installed in the directional drill 500 for insertion into the drill string to extend the drill string outward to a desired destination.

After installation of the second drill string 520, in operation series 308, a preprogrammed engine speed is implemented. As discussed above, in one example, the preprogrammed engine speed sets the engine within a portion of its power curve that is sufficient for the power needs of directional drill components. In one example, the engine speed is set to provide sufficient power to a hydraulic pump or pumps that supply hydraulic fluid to the individual components. In operation series 308, the drill head 506 is actuated to rotate clockwise for anticipated engagement of the second drill stem segment 520 with the drill stem segment 502 to form a continuous drill string.

Figure 5C:
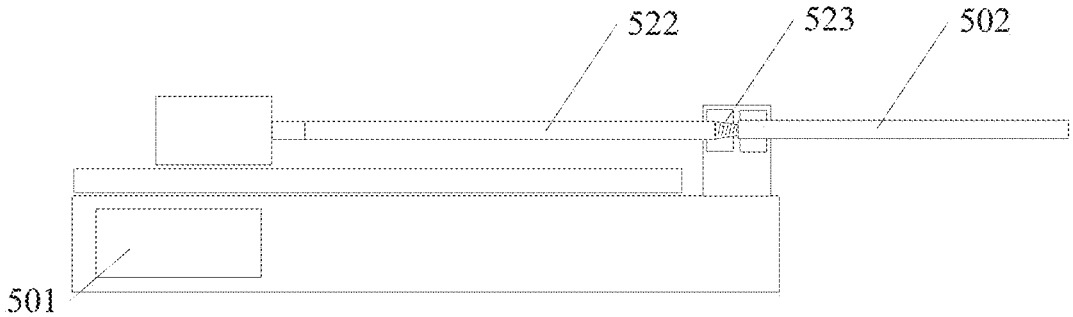
Figure 5D:
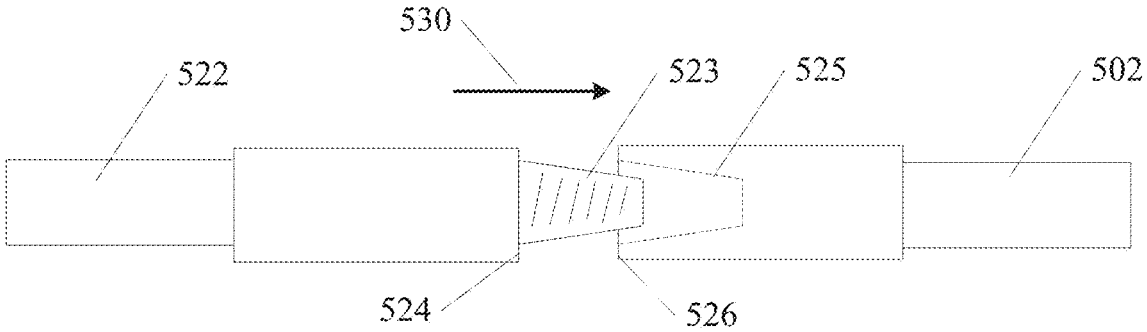

FIG. 5C and close up view 5D illustrate some of the portions of operation series 308. In the operation series 308, the drill head 506 and second drill stem segment 520 are moved towards the drill stem segment 502 and stopped with threads 523 of the second drill stem segment 520 just short of corresponding threads 525 of the drill stem segment 502. In one example, while the drill head 506 is rotating, a short duration forward thrust along carriage 510 brings a front of threads 523 into contact with corresponding threads 525. In one example, the short duration forward thrust "bumps" the threads 523 into corresponding threads 525 in an amount sufficient to overcome friction and/or any imperfections or debris between the threads 523, 525 and to enable the threads 523, 525 to begin engaging with one another. In one example, after the "bump" forward thrust, the circuitry 501 disengages the drill head 506 from the carriage 510 and allows its linear location to float. The circuitry 501 then monitors a linear location of the drill head 506 to detect linear motion resulting from the threads 523, 525 engaging with one another and pulling the second drill stem segment 520 into the drill stem segment 502. In one example, a rate of linear movement 530 will match the previously detected and stored rate of threading/unthreading discussed above. In one example, detecting an expected rate of threading/unthreading that matches the stored value is used as a flag that correct engagement between threads 523, 525 has been achieved. In one example, monitoring linear motion includes monitoring a linear encoder reading between the drill head 506 and the carriage 510. Other methods of monitoring linear motion are also within the scope of the invention.

In one example, the short duration forward thrust "bump" may not succeed in engaging threads 523, 525 after a first attempt. Operation series 310 provides one example of a number of operations to complete a threading operation. In one example, a feedback loop is used in circuitry 501 to look for linear motion of the drill head 506 while floating on the carriage. If linear motion is not detected, a second short duration forward thrust "bump" is implemented and the drill head 506 is again checked for linear motion. In one example, the short duration forward thrust "bump" is repeated until linear motion of the drill head 506 is detected. In one example, a chosen number of short duration forward thrust "bump" attempts is programmed into the circuitry 501, after which an indication is provided to the operator that threading is unsuccessful.

In operation series 310, once linear motion is detected and threading is indicated, a thread torque sequence is completed. In one example, opposing thread joint faces 524 and 526 eventually butt against one another, and a desired torque setting is applied to the second drill stem segment 520 against the drill stem segment 502 that is fixed as a result of being clamped in the front vise 505, of the drill stem vise 504. In one example, a torque sequence is indicated to circuitry 501 as completed when a thrust pressure sensor rises to a specified threshold. In one example, a torque sequence is indicated to circuitry 501 as completed when a hydraulic fluid pressure sensor rises to a specified threshold. Hydraulic fluid pressure can be measured in a number of components, including but not limited to, linear thruster, drill head motor rotational drive, etc. In one example, a torque sequence is indicated to circuitry 501 as completed when a linear motion of the drill head decreases or stops, as detected by a linear encoder on the carriage.

After the threads 523, 525 are torqued to a desired value, the threading process is considered complete, and rotation of the drill head 506 is stopped. The front vise 505, of the drill stem vise 504 is then opened, as indicated in operation series 312. The drill string is then drilled/extended out by one more drill stem segment distance, and if desired, the process is repeated, starting back at operation series 302 to add subsequent drill stem segments.

It can be difficult to automate threads 523, 525 to engage at exactly the right initiation point. If threads 523, 525 are brought into contact and forced to engage without a "bump,", unwanted cross threading can occur where the threads are not properly engaged, and the threads 523, 525 instead cut across one another, damaging the drill stem segments. By using the described short duration forward thrust "bump" operation and "float" to initiate thread engagement, the process can be automated successfully despite not having exact knowledge of a rotational orientation of the second drill stem segment 520 in relation to the drill stem segment 502, and despite any imperfections and/or debris that may be present.

FIG. 4 shows a sequential list 400 of operations that automate selected operations of retracting a drill string from a directional drill. FIGS. 6A-6D illustrate selected stages of operations of a directional drill 600 in block diagram form and are referenced in discussion of operations.

In operation series 402, a preprogrammed engine speed is implemented. As discussed above, in one example, the preprogrammed engine speed sets the engine within a portion of its power curve that is sufficient for the power needs of directional drill components. In one example, the engine speed is set to provide sufficient power to a hydraulic pump or pumps that supply hydraulic fluid to the individual components. The front 605 and rear 603 vise of the drill stem vise 604 are activated, and a wrench (not shown) is actuated to "break" the joint interface 608 between a second drill stem segment 620 and a drill stem segment 602.

Figure 6A:
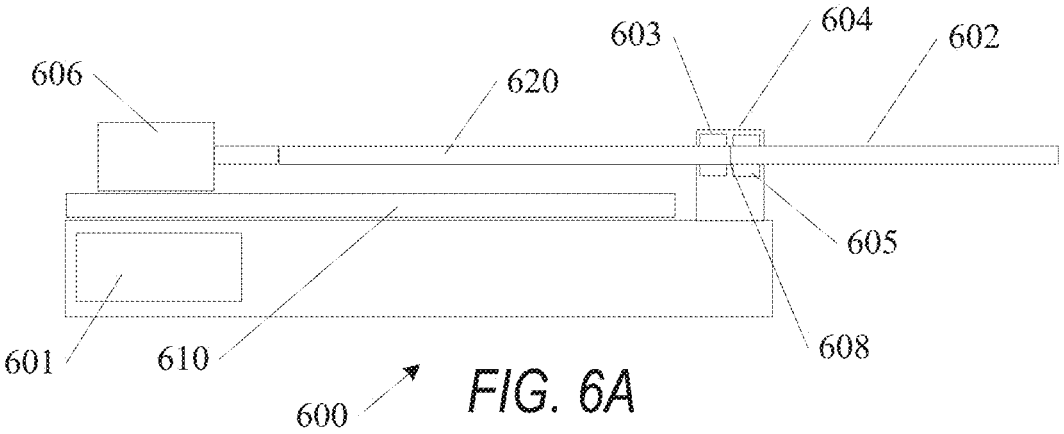
FIG. 6A-6D show selected stages of operations from FIG. 4 in block diagram format in accordance with some example embodiments.
Figure 6B:
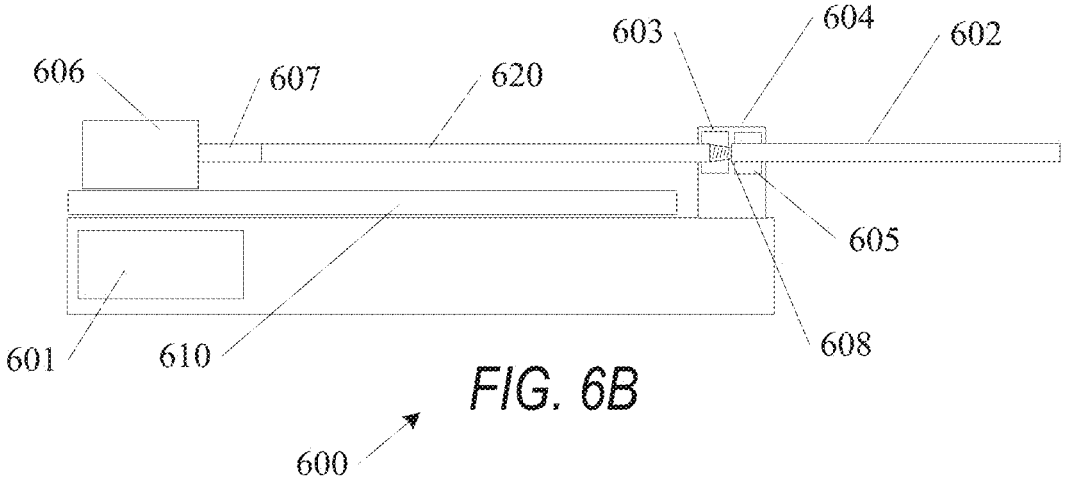
Figure 6C:
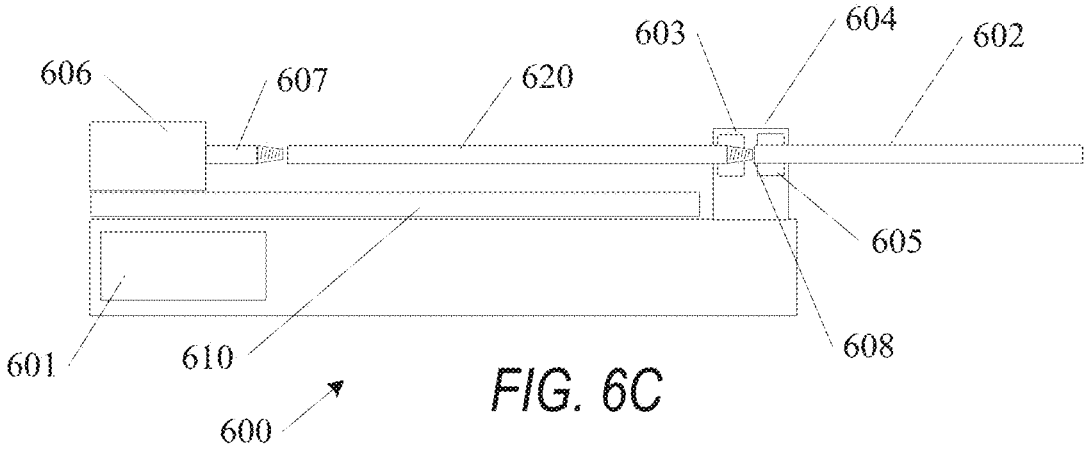
Figure 6D:
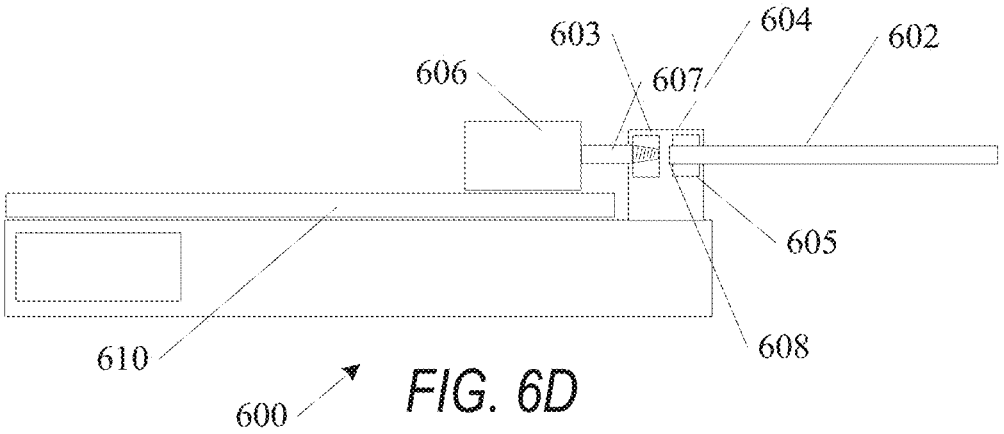

The rear vise 603 is then opened and the drill head 606 is counter rotated to begin untreading the second drill stem segment 620 from the drill stem segment 602. In one example, the rate of threading/unthreading (linear speed) that was stored from operation series 304 is used as a rearward rate of motion for the drill head 606 to move along the carriage 610. Once the second drill stem segment 620 is completely unthreaded from the drill stem segment 602, the drill head 606 is moved to a position in the rear vise 603 as shown in FIG. 6B, and the rear vise 603 is again actuated to clamp on the second drill stem segment 620. The drill head 606 is again counter rotated to begin untreading the second drill stem segment 620 from the sub saver 607. In one example, the rate of threading/unthreading (linear speed) that was stored from operation series 304 is used as a rearward rate of motion for the drill head 606 to move along the carriage 610. Once the second drill stem segment 620 is completely unthreaded from the sub saver 607, the drill head 606 is moved to a rear of the carriage 610 to allow removal of the second drill stem segment 620, as shown in FIG. 6C.

In operation series 404, the drill head 606 is moved forward towards the drill stem segment 602 that remains in the front vise 605. In one example, the drill head 606 first stops with threads of the sub saver 607 located at a greasing station between the vise 604 and the rear of the carriage 610. Grease is applied to the threads of the sub saver 607, and the drill head 606 then continues to the drill stem segment 602. The directional drill condition is now illustrated in FIG. 6D.

The drill head 606 and sub saver 607 are moved towards the drill stem segment 602 and stopped with threads of the sub saver 607 just short of corresponding threads of the drill stem segment 602. In one example, an operation of threading the sub saver 607 into the drill stem segment 602 is executed substantially the same as described with respect to FIG. 5D and series of operations 308 and 310 described above. In one example, while the drill head 606 is rotating, a short duration forward thrust along carriage 610 brings a front of threads of the sub saver 607 into contact with corresponding threads 525. In one example, the short duration forward thrust "bumps" the threads of the sub saver 607 into corresponding threads 525 in an amount sufficient to overcome friction and/or any imperfections or debris between the threads and to enable the threads to begin engaging with one another. In one example, after the "bump" forward thrust, the circuitry 601 disengages the drill head 606 from the carriage 610 and allows its linear location to float. The circuitry 601 then monitors a linear location of the drill head 606 to detect linear motion resulting from the threads engaging with one another and pulling the sub saver 607 into the drill stem segment 602. In one example, a rate of linear movement 530 will match the previously detected and stored rate of threading/unthreading discussed above. In one example, detecting an expected rate of threading/unthreading that matches the stored value is used as a flag that correct engagement between threads has been achieved.

In one example, the short duration forward thrust "bump" may not succeed in engaging threads of the sub saver 607 and threads 525 after a first attempt. Operation series 406 provides one example of a number of operations to complete a threading operation. In one example, a feedback loop is used in circuitry 601 to look for linear motion of the drill head 606 while floating on the carriage. If linear motion is not detected, a second short duration forward thrust "bump" is implemented and the drill head 606 is again checked for linear motion. In one example, the short duration forward thrust "bump" is repeated until linear motion of the drill head 506 is detected. In one example, a chosen number of short duration forward thrust "bump" attempts is programmed into the circuitry 601, after which an indication is provided to the operator that threading is unsuccessful.

Once linear motion is detected and threading is indicated, a thread torque sequence is completed. After the threads are torqued to a desired value, the threading process is considered complete, and rotation of the drill head 606 is stopped. The front vise 605 of the drill stem vise 604 is then opened, as indicated in operation series 408. The drill stem segment 602 is then pulled back, and if desired, the process is repeated, starting back at operation series 402 to remove subsequent drill stem segments.

In one example, operation series 402, 404, 406, and 408 are all performed automatically using programmed circuitry 601. In one example, after operation series 402, an operator manually removes a drill stem segment from the horizontal directional drill to shorten the drill stem during a pullback operation.

Figure 7:
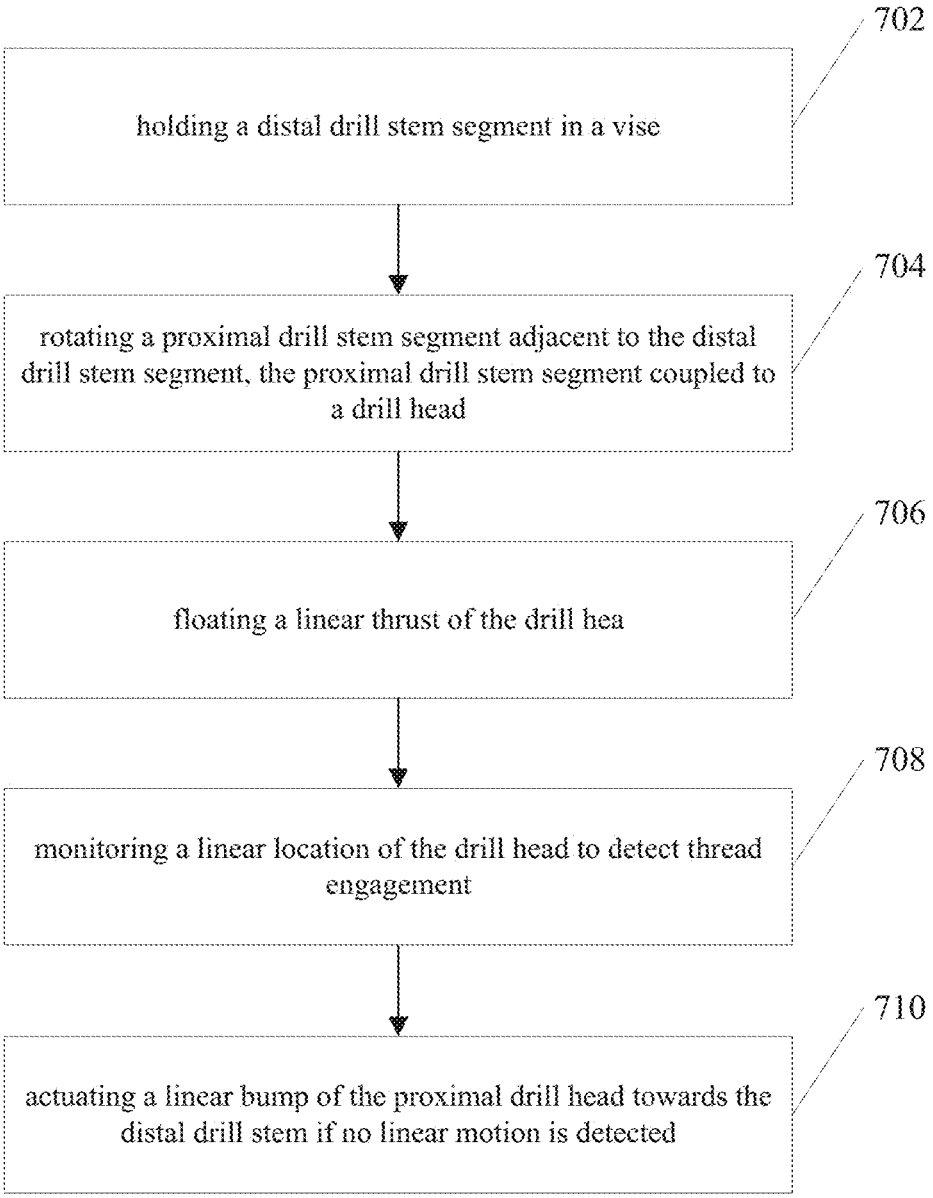
FIG. 7 shows an example method diagram for operation of a directional drill in accordance with some example embodiments.

FIG. 7 shows a flow diagram of one example of a method of automatically threading a drill stem segment. In operation 702, a distal drill stem segment is held in a vise. In operation 704, a proximal drill stem segment is rotated adjacent to the distal drill stem segment, the proximal drill stem segment being coupled to a drill head. In operation 706, a linear thrust of the drill head is floated. In operation 708, a linear location of the drill head is monitored to detect thread engagement, and in operation 710 a linear bump of the proximal drill head is actuated towards the distal drill stem if no linear motion is detected.

Figure 8:
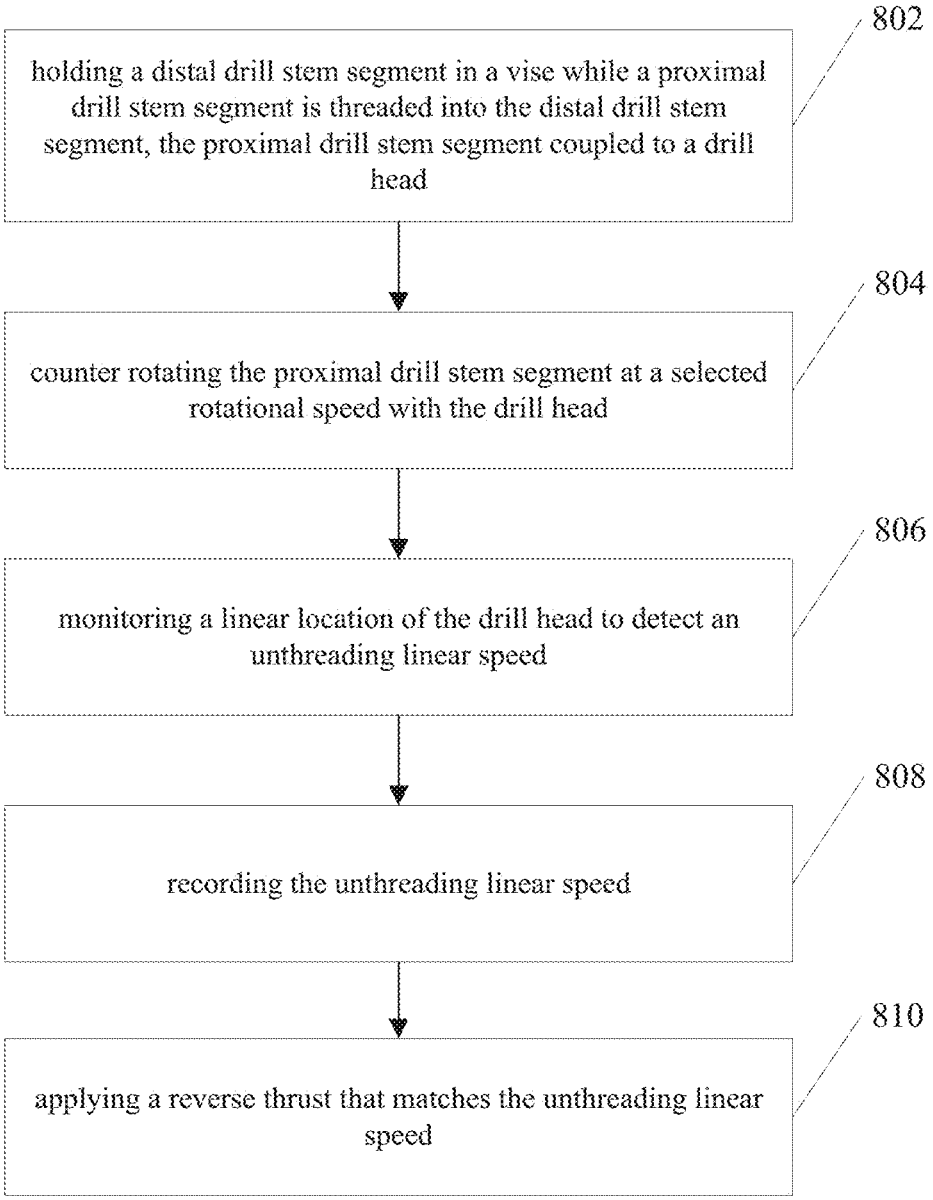
FIG. 8 shows another example method diagram for operation of a directional drill in accordance with some example embodiments.

FIG. 8 shows a flow diagram of one example of a method of automatically unthreading a drill stem segment. In operation 802, a distal drill stem segment is held in a vise while a proximal drill stem segment is threaded into the distal drill stem segment, the proximal drill stem segment being coupled to a drill head. In operation 804, the proximal drill stem segment is counter rotated at a selected rotational speed with the drill head. In operation 806, a linear location of the drill head is monitored to detect an unthreading linear speed. In operation 808, the unthreading linear speed is recorded, and in operation 810, a reverse thrust that matches the unthreading linear speed is applied.

To better illustrate the method and apparatuses disclosed herein, a non-limiting list of embodiments is provided here:

Example 1 includes a method of automatically threading a drill stem segment. The method includes holding a distal drill stem segment in a vise, rotating a proximal drill stem segment adjacent to the distal drill stem segment, the proximal drill stem segment coupled to a drill head, floating a linear thrust of the drill head, monitoring a linear location of the drill head to detect thread engagement, and actuating a linear bump of the proximal drill head towards the distal drill stem if no linear motion is detected.

Example 2 includes the method of example 1, further including sensing a grip of the distal drill stem segment in the vise using a pressure sensor.

Example 3 includes the method of any one of examples 1-2, further including repeating actuation of the linear bump and rotating of the proximal drill stem segment periodically until linear motion is detected.

Example 4 includes the method of any one of examples 1-3, wherein rotating a proximal drill stem segment includes rotating a sub saver.

Example 5 includes the method of any one of examples 1-4, wherein rotating a proximal drill stem segment includes rotating a drill stem segment coupled to a sub saver.

Example 6 includes the method of any one of examples 1-5, further including sensing when a drill stem joint between the proximal drill stem segment and the distal drill stem segment is fully threaded.

Example 7 includes the method of any one of examples 1-6, wherein sensing includes detecting a thrust pressure rise.

Example 8 includes the method of any one of examples 1-7, wherein sensing includes detecting a torque pressure rise.

Example 9 includes the method of any one of examples 1-8, wherein sensing includes detecting a decrease in linear motion.

Example 10 includes a method of automatically unthreading a drill stem segment. The method includes holding a distal drill stem segment in a vise while a proximal drill stem segment is threaded into the distal drill stem segment, the proximal drill stem segment coupled to a drill head. The method also includes counter rotating the proximal drill stem segment at a selected rotational speed with the drill head, monitoring a linear location of the drill head to detect an unthreading linear speed, recording the unthreading linear speed, and applying a reverse thrust that matches the unthreading linear speed.

Example 11 includes the method of example 10, wherein monitoring a linear location of the drill head includes reading output from a linear encoder that is correlated to the drill head.

Example 12 includes the method of any one of examples 10-11, wherein counter rotating the proximal drill stem segment at a selected rotational speed includes controlling an engine speed that is correlated to a drill head rotation speed.

Example 13 includes the method of any one of examples 10-12, further including breaking loose a torqued threaded joint between the proximal drill stem segment and the distal drill stem segment prior to counter rotating the proximal drill stem segment at the selected rotational speed.

Example 14 includes the method of any one of examples 10-13, further including moving the drill head to a rear of a drill carriage after a linear distance of the drill head is measured that indicates the proximal drill stem segment has been unthreaded from the distal drill stem segment.

Example 15 includes the method of any one of examples 10-14, further including manually removing the proximal drill stem segment from the drill carriage after the drill head has moved to the rear of the drill carriage.

Example 16 includes the method of any one of examples 10-15, further including moving the drill head forward toward the distal drill stem segment and greasing a thread on the drill head before engaging a corresponding thread on the distal drill stem segment for subsequent extraction of the distal drill stem segment.

Example 17 includes a horizontal directional drill. The horizontal directional drill includes a drill carriage, including a drill stem vise at a distal end, and a drill head movable along a linear axis of the drill carriage. The horizontal directional drill also includes a linear encoder coupled to the drill carriage to detect a location of the drill head. The horizontal directional drill also includes a control circuit configured to actuate the drill stem vise to hold a distal drill stem segment when in operation, rotate a proximal drill stem segment adjacent to the distal drill stem segment when in operation, the proximal drill stem segment coupled to the drill head, float a linear thrust of the drill head, monitor a linear location of the drill head to detect thread engagement, and actuate a linear bump of the proximal drill head towards the distal drill stem if no linear motion is detected.

Example 18 includes the horizontal directional drill of example 17, wherein the control circuit is further configured to hold a distal drill stem segment in a vise when a proximal drill stem segment is threaded into the distal drill stem segment, the proximal drill stem segment coupled to a drill head, counter rotate the proximal drill stem segment at a selected rotational speed with the drill head, monitor a linear location of the drill head to detect an unthreading linear speed, record the unthreading linear speed, and apply a reverse thrust that matches the unthreading linear speed.

Example 19 includes the horizontal directional drill of any one of examples 17-18, wherein the control circuit is further configured to move the drill head to a rear of a drill carriage after a linear distance of the drill head is measured that indicates the proximal drill stem segment has been unthreaded from the distal drill stem segment.

Example 20 includes the horizontal directional drill of any one of examples 17-19, wherein the control circuit is further configured to move the drill head forward toward the distal drill stem segment and greasing a thread on the drill head before engaging a corresponding thread on the distal drill stem segment.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The Detailed Description, therefore, is not to be taken in a limiting sense, and the scope of various embodiments is defined only by the appended claims, along with the full range of equivalents to which such claims are entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

The foregoing description, for the purpose of explanation, has been described with reference to specific example embodiments. However, the illustrative discussions above are not intended to be exhaustive or to limit the possible example embodiments to the precise forms disclosed. Many modifications and variations are possible in view of the above teachings. The example embodiments were chosen and described in order to best explain the principles involved and their practical applications, to thereby enable others skilled in the art to best utilize the various example embodiments with various modifications as are suited to the particular use contemplated.

It will also be understood that, although the terms "first," "second," and so forth may be used herein to describe various elements, these elements should not be limited by these terms. These terms are only used to distinguish one element from another. For example, a first contact could be termed a second contact, and, similarly, a second contact could be termed a first contact, without departing from the scope of the present example embodiments. The first contact and the second contact are both contacts, but they are not the same contact.

The terminology used in the description of the example embodiments herein is for the purpose of describing particular example embodiments only and is not intended to be limiting. As used in the description of the example embodiments and the appended examples, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

The invention claimed is:

1. A method of automatically threading drill stem segments, comprising:

holding a distal drill stem segment in a vise;

rotating a proximal drill stem segment adjacent to the distal drill stem segment, the proximal drill stem segment coupled to a drill head;

floating the drill head;

checking for a lack of linear motion while rotating the proximal drill stem segment; and applying a linear bump of the proximal drill stem segment towards the distal drill stem segment when the lack of linear motion while rotating the proximal drill stem segment is detected.

2. The method of claim 1, further including sensing a grip of the distal drill stem segment in the vise using a pressure sensor.

3. The method of claim 1, further including repeating actuation of the linear bump and rotating of the proximal drill stem segment periodically until linear motion is detected.

4. The method of claim 1, wherein rotating the proximal drill stem segment includes rotating a sub saver.

5. The method of claim 1, wherein rotating the proximal drill stem segment includes rotating a drill stem segment coupled to a sub saver.

6. The method of claim 1, further including sensing when a drill stem joint between the proximal drill stem segment and the distal drill stem segment is fully threaded.

7. The method of claim 6, wherein sensing includes detecting a thrust pressure rise.

8. The method of claim 6, wherein sensing includes detecting a torque pressure rise.

9. The method of claim 6, wherein sensing includes detecting a decrease in linear motion.

10. A method of automatically unthreading drill stem segments, comprising:

holding a distal drill stem segment in a vise while a proximal drill stem segment is threaded into the distal drill stem segment, the proximal drill stem segment coupled to a drill head;

counter rotating the proximal drill stem segment at a selected rotational speed with the drill head;

monitoring a linear location of the drill head to detect an unthreading linear speed;

recording the unthreading linear speed; and applying a reverse thrust to the drill head that matches the unthreading linear speed.

11. The method of claim 10, wherein monitoring the linear location of the drill head includes reading output from a linear encoder that is correlated to the drill head.

12. The method of claim 10, wherein counter rotating the proximal drill stem segment at the selected rotational speed includes controlling an engine speed that is correlated to a drill head rotation speed.

13. The method of claim 10, further including breaking loose a torqued threaded joint between the proximal drill stem segment and the distal drill stem segment prior to counter rotating the proximal drill stem segment at the selected rotational speed.

14. The method of claim 10, further including moving the drill head to a rear of a drill carriage after a linear distance of the drill head is measured that indicates the proximal drill stem segment has been unthreaded from the distal drill stem segment.

15. The method of claim 14, further including manually removing the proximal drill stem segment from the drill carriage after the drill head has moved to the rear of the drill carriage.

16. The method of claim 10, further including moving the drill head forward toward the distal drill stem segment and greasing a thread on the drill head before engaging a corresponding thread on the distal drill stem segment for subsequent extraction of the distal drill stem segment.

17. A horizontal directional drill, comprising:

a drill carriage, including a drill stem vise at a distal end, and a drill head movable along a linear axis of the drill carriage;

a linear encoder coupled to the drill carriage to detect a location of the drill head;

a control circuit configured to;

actuate the drill stem vise to hold a distal drill stem segment when in operation;

rotate a proximal drill stem segment adjacent to the distal drill stem segment when in operation, the proximal drill stem segment coupled to the drill head;

float the drill head;

monitor a linear location of the drill head to detect thread engagement; and apply a linear bump of the proximal drill stem segment towards the distal drill stem segment if no linear motion is detected.

18. The horizontal directional drill of claim 17, wherein the control circuit is further configured to:

hold the distal drill stem segment in the drill stem vise when the proximal drill stem segment is threaded into the distal drill stem segment, the proximal drill stem segment coupled to the drill head;

counter rotate the proximal drill stem segment at a selected rotational speed with the drill head;

monitor the linear location of the drill head to detect an unthreading linear speed;

record the unthreading linear speed; and apply a reverse thrust that matches the unthreading linear speed.

19. The horizontal directional drill of claim 17, wherein the control circuit is further configured to move the drill head to a rear of the drill carriage after a linear distance of the drill head is measured that indicates the proximal drill stem segment has been unthreaded from the distal drill stem segment.

20. The horizontal directional drill of claim 17, wherein the control circuit is further configured to move the drill head forward toward the distal drill stem segment and greasing a thread on the drill head before engaging a corresponding thread on the distal drill stem segment.

* * * * *